US010543857B2

(12) United States Patent
Dausoa et al.

(10) Patent No.: US 10,543,857 B2
(45) Date of Patent: Jan. 28, 2020

(54) RAIL VEHICLE PROVIDED WITH A LEVELING AND ASSOCIATED RUNNING METHOD

(71) Applicant: ALSTOM Transport Technologies, Saint-Ouen (FR)

(72) Inventors: Sacheen Dausoa, Le Creusot (FR); Yves Longueville, Torcy (FR)

(73) Assignee: ALSTOM TRANSPORT TECHNOLOGIES, Saint-Ouen (FR)

( * ) Notice: Subject to any disclaimer, the term of this patent is extended or adjusted under 35 U.S.C. 154(b) by 300 days.

(21) Appl. No.: 15/616,999

(22) Filed: Jun. 8, 2017

(65) Prior Publication Data

US 2017/0355386 A1 Dec. 14, 2017

(30) Foreign Application Priority Data

Jun. 9, 2016 (FR) ..... 16 55285

(51) Int. Cl.
*B61F 5/16* (2006.01)
*B61F 5/06* (2006.01)

(52) U.S. Cl.
CPC . *B61F 5/06* (2013.01); *B61F 5/16* (2013.01)

(58) Field of Classification Search
CPC ..... B61F 5/14; B61F 5/20; B61F 5/22; B61F 5/386; B60G 17/0272; B60G 2500/30; B60G 2202/413; B60G 2300/10; B60G 2800/914
See application file for complete search history.

(56) References Cited

U.S. PATENT DOCUMENTS

| | | | | |
|---|---|---|---|---|
| 6,637,348 | B1 | 10/2003 | Teichmann et al. | |
| 7,168,370 | B2 | 1/2007 | Hommen et al. | |
| 7,520,494 | B2 | 4/2009 | Gaile | |
| 9,878,727 | B2 * | 1/2018 | Gaile | B61F 5/06 |
| 2004/0016361 | A1 | 1/2004 | Teichmann et al. | |
| 2008/0210119 | A1 | 9/2008 | Lehmair et al. | |
| 2015/0021445 | A1 | 1/2015 | Franks et al. | |

FOREIGN PATENT DOCUMENTS

| | | |
|---|---|---|
| DE | 103 60 517 A1 | 8/2005 |
| EP | 1 391 331 A2 | 2/2004 |
| WO | 2012/115927 A1 | 8/2012 |

OTHER PUBLICATIONS

FR Search Report, dated Feb. 6, 2017, corresponding to FR 16 55285 application.

* cited by examiner

*Primary Examiner* — Mark T Le
(74) *Attorney, Agent, or Firm* — Young & Thompson

(57) ABSTRACT

A rail vehicle that includes at least one car and at least one bogie that carries the car, the bogie including a chassis and a secondary suspension system between the chassis and the car, wherein the secondary suspension system includes a spring assembly mounted between the chassis and the car, the secondary suspension system including an actuator, provided with a piston extending at least partially between an upper stop secured to the car and a lower stop secured to the chassis, and a supply device of the actuator, and wherein supply device of the actuator is configured to supply the actuator such that the distance between the upper and lower stops is kept constant.

8 Claims, 3 Drawing Sheets

RAIL VEHICLE PROVIDED WITH A LEVELING AND ASSOCIATED RUNNING METHOD

FIELD OF THE INVENTION

Figure 1:
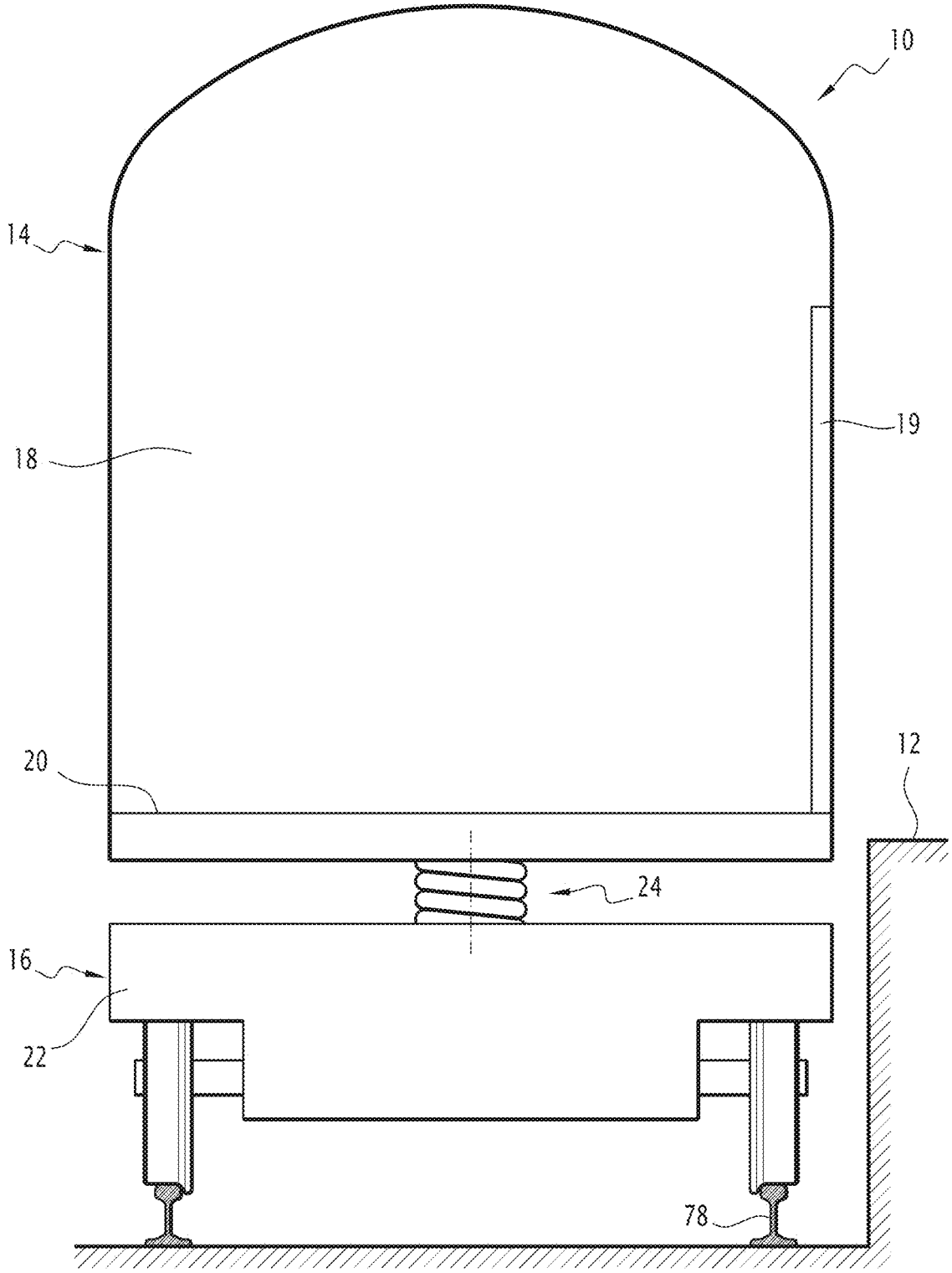

The present invention relates to a railway vehicle comprising at least one car and at least one bogie carrying the car, the bogie comprising:

a chassis, and a secondary suspension system between the chassis and the car, the secondary suspension system comprising a spring assembly mounted between the chassis and the car.

BACKGROUND OF THE INVENTION

In order to facilitate the embarking and disembarking of persons and/or goods, it is advantageous to be able to adjust the height of the car, in order to adapt it to that of the platform.

Document US 2015021445 describes a rail vehicle comprising a car and a bogie, a suspension spring extending between the car and the bogie. A piston is able to raise or lower the low point of the spring connected to the bogie. Using the spring, the height of the car is variable. This in particular makes it possible to reduce the vertical distance between the floor of the car and a platform.

However, the height of the car must then be adjusted upon each stop at a platform. This for example requires slaving in order to know the current height of the car relative to the desired height, which in particular depends on the mass of the persons and/or goods on board the car and other variables.

This leveling system is therefore complicated to implement.

SUMMARY OF THE INVENTION

The invention in particular aims to resolve this drawback, by proposing a leveling system that is easy to implement.

To that end, the invention in particular relates to a rail vehicle of the aforementioned type, wherein the secondary suspension system comprises an actuator, provided with a piston extending at least partially between an upper stop secured to the car and a lower stop secured to the chassis, and a supply device of the actuator, the supply device of the actuator being able to supply the actuator such that the distance between the upper and lower stops is kept constant by the actuator.

The actuator thus keeps the chassis of the car at a constant distance in the vertical direction, in particular without depending on the load of the vehicle. The distance is for example chosen so that the height of the floor of the car when stopped at a station is substantially equal to the height of the platform of that station.

A rail vehicle according to the invention may further include one or more of the following features, considered alone or according to any technically possible combination(s):

the upper stop and the lower stop are vertically aligned, the actuator comprises a cylinder, the piston separating the cylinder into an upper chamber and a lower chamber, and in that the supply device of the actuator is configured to supply the upper and lower chambers, the supply device of the actuator is able to supply the actuator such that the piston is substantially comprised completely in the cylinder, the actuator comprises a cylinder, the piston separating the cylinder into an upper chamber and a lower chamber, and in that the supply device of the actuator is configured to supply only one of the upper and lower chambers, the other of the upper and lower chambers being equipped with a return spring configured to return the piston to a rest position inside the cylinder, when the actuator is not supplied by the supply device, the supply device of the actuator is able to supply the actuator such that the piston comes into contact with the lower stop and the upper stop, the actuator then being in a maximum vertical travel position and the distance between the upper and lower stops being kept constant, the actuator comprises a cylinder secured to the car, in that the piston comprises a head and a rod extending from the head and traversing the cylinder, and in that the supply device of the actuator is able to supply the actuator such that the head of the piston is kept abutting against the upper stop and the rod of the piston is kept abutting against the lower stop, the cylinder comprises an end, the upper stop being fastened to said end, the upper stop being provided with a passage orifice for the rod, and the actuator is situated inside the spring assembly along a main axis of the secondary suspension.

The invention also relates to a running method of a rail vehicle as previously defined, comprising the following steps:

running of the rail vehicle, the actuator being supplied by the supply device, so as to allow a relative movement between the chassis and the car, and stop of the rail vehicle at a platform, the actuator being supplied by the supply device, so as to keep the distance between the chassis and the car constant.

BRIEF DESCRIPTION OF THE INVENTION

Figure 2:
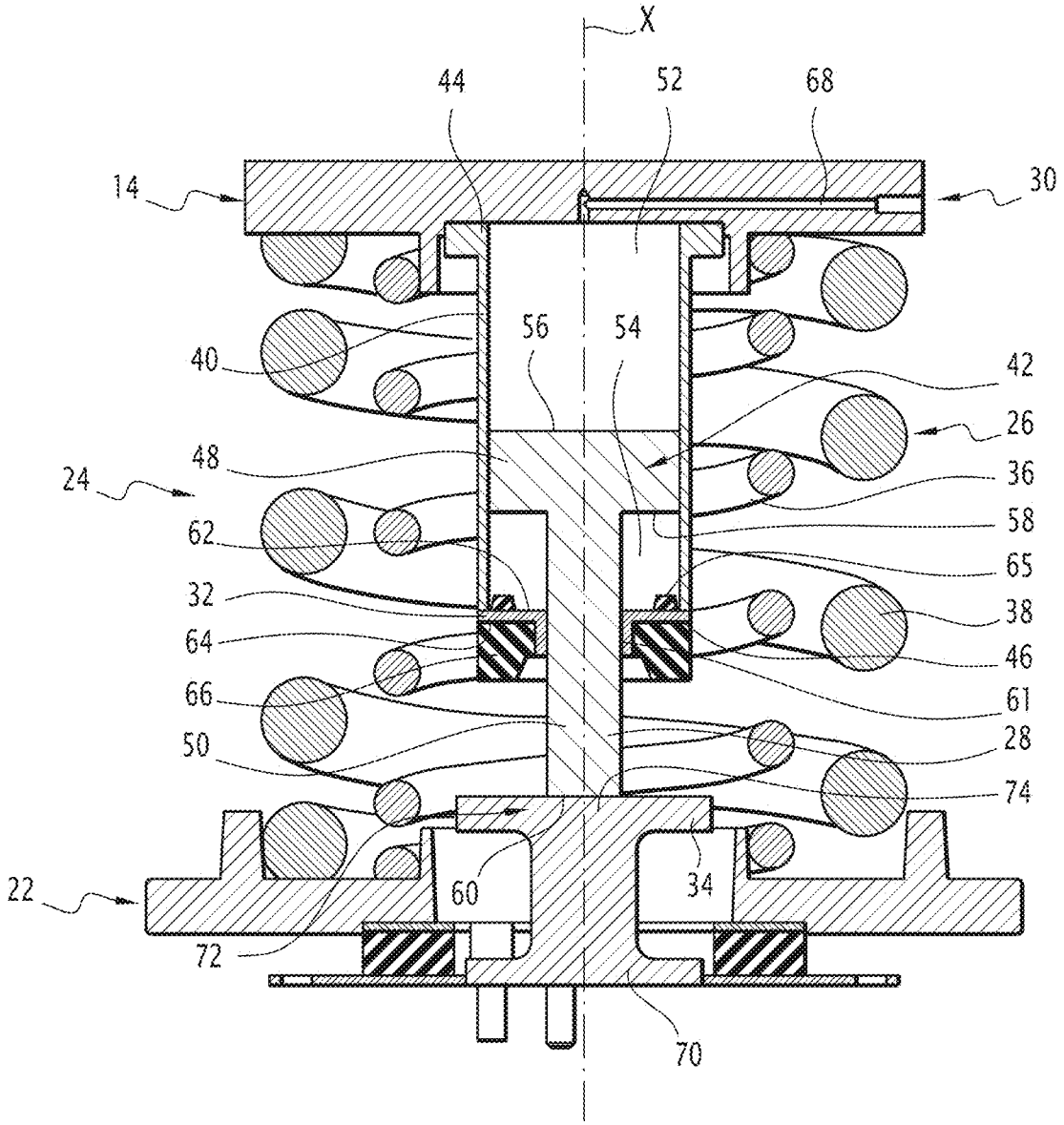
Figure 3:
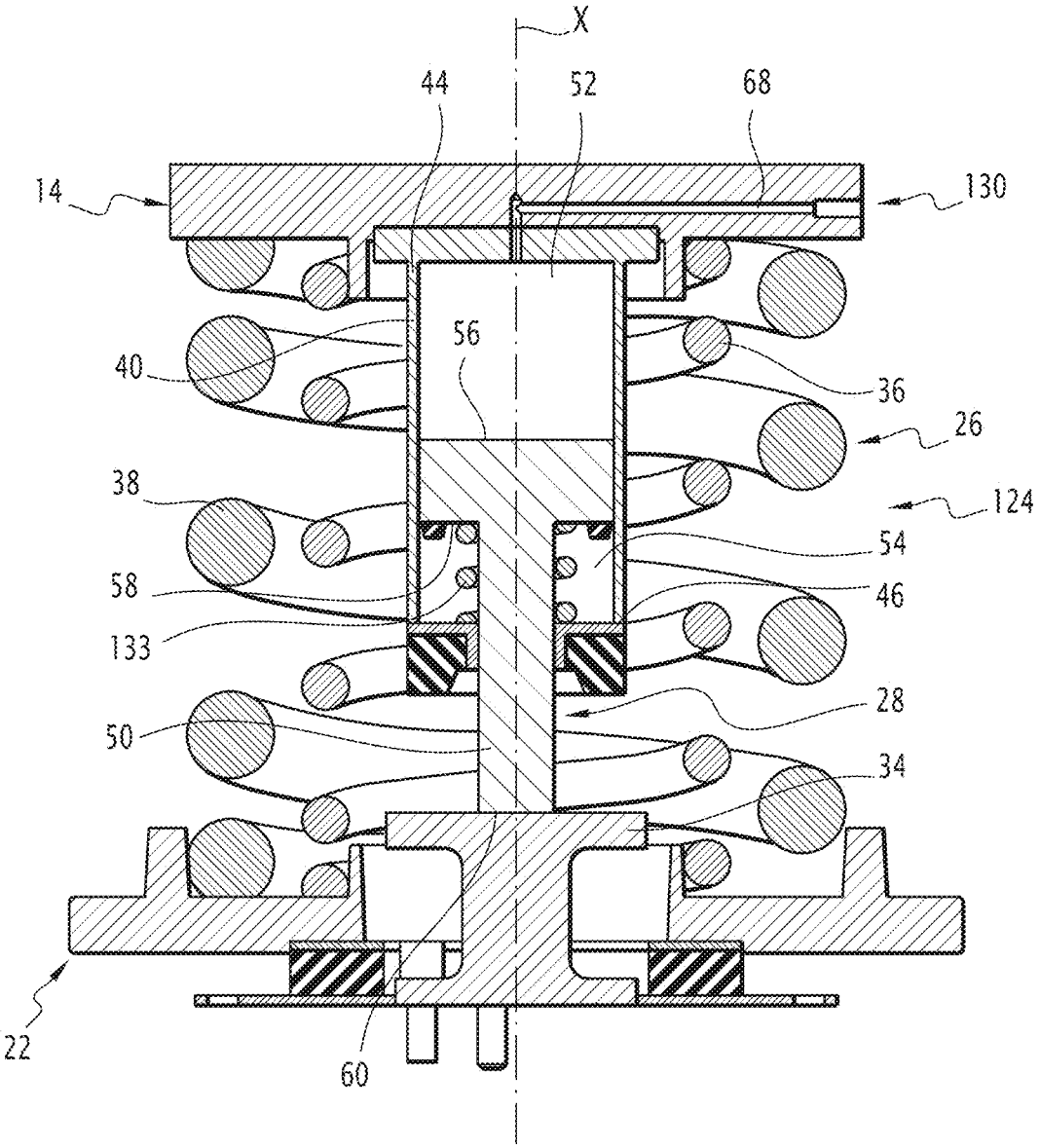

The invention will be better understood using the following description, provided solely as an example and done in reference to the appended figures, in which:

FIG. 1 is a schematic view of a rail vehicle stopped at a station according to a first example embodiment of the invention, FIG. 2 is a schematic sectional view along a vertical plane of a secondary suspension system of the rail vehicle of FIG. 1, according to a first embodiment of the invention, and FIG. 3 is a view similar to FIG. 2 of a secondary suspension system according to a second embodiment of the invention.

DETAILED DESCRIPTION OF THE INVENTION

The terms "vertical" and "horizontal" are to be understood generally relative to the typical directions of a rail vehicle running on rails.

A rail vehicle 10 stopped at a station is shown in FIG. 1.

The station comprises at least one platform 12, such that the rail vehicle 10 is stopped along the platform 12.

The rail vehicle 10 comprises at least one car 14 and at least one bogie 16 carrying the car 14.

The bogie 16 for example extends at one end of the car 14 and supports two adjacent cars.

According to one conventional embodiment, the car 14 is supported by two bogies 16 at each of its ends.

The car 14 has an empty inner volume 18 configured to receive people or goods to be transported.

The inner volume 18 communicates with the outside via at least one door 19.

The inner volume 18 is in particular defined by a lower floor 20, on which the people and/or goods move.

The bogie 16 comprises a chassis 22 and a secondary suspension system 24 between the chassis 22 and the car 14.

The secondary suspension system 24 makes it possible to react the vertical movements between the car 14 and the bogie 16. The secondary suspension system in particular makes it possible to perform both the suspension function between the car 14 and the bogie 16 and the vertical positioning function of the car 14 relative to the train station platform 12.

To that end, the secondary suspension system 24, shown in FIG. 2, comprises a spring assembly 26 mounted between the car chassis 22 and the car 14 and performing the suspension function, and an actuator 28 performing a vertical positioning function of the car 14 relative to the train station platform 12.

The secondary suspension system 24 further comprises a supply device 30 of the actuator 28, an upper stop 32 secured to the car 14 and a lower stop 34 secured to the chassis 22.

The upper stop 32 and the lower stop 34 are intended to limit the vertical movement of the actuator 28.

The secondary suspension system 24 extends along a main axis X.

The main axis X is vertical.

The spring assembly 26 extends along the main axis X.

According to the embodiment shown in the figures, the spring assembly 26 comprises an inner spring 36 and an outer spring 38.

The inner spring 36 and the outer spring 38 are helical and coaxial springs, having the main axis X as central axis.

They each extend between the chassis 22 and the car 14. They are further secured to the chassis 22 and the car 14.

The diameter of the inner spring 36 is smaller than the diameter of the outer spring 38, such that the inner spring 36 extends in the inner volume of the outer spring 38.

The inner spring 36 and the outer spring 38 have opposite winding directions.

When the car 14 is empty, the inner spring 36 and the outer spring 38 for example have a height, defined vertically, comprised between 270 mm and 275 mm.

The diameter of the inner spring 36 is substantially equal to 140 mm. The diameter of the outer spring 38 is substantially equal to 270 mm.

The flexibility of the spring assembly 26 is equal to about 21 mm for 1000 daN, the flexibility being defined as the loss of height per load unit.

The spring assembly 26 allows a relative movement between the chassis 22 and the car 14.

The lower stop 34 extends along the main axis X between a first end 70, secured to the chassis 22, and a second end 72, facing the upper stop 32.

The lower stop 34 extends radially from the main axis X and at least partially in the inner volume of the inner spring 36.

The second end 72 has a lower stop bearing 74.

The actuator 28 extends between the car 14 and the bogie 16.

The actuator 28 is situated inside the spring assembly 26 along the main axis X. The actuator 28 extends at least partially in the inner volume of the inner spring 36.

The actuator 28 is for example hydraulic.

The actuator 28 comprises, traditionally, a cylinder 40 and a piston 42.

The cylinder 40 extends between a first end 44, secured to the car, and a second end 46, facing the lower stop 34, along the main axis X.

The cylinder 40 is closed by the car 14 at its first end 44.

The upper stop 32 here is present at the second end 46 of the cylinder 40.

The upper stop 32 extends radially around the main axis X.

The upper stop 32 has an inner surface 62 partially closing the cylinder 40 and an outer surface 64 facing the lower stop 34.

The upper stop 32 defines a passage orifice 61, more particularly at its center.

The piston 42 is movable in the cylinder 40 and comprises a head 48 and a rod 50 secured to the head 48.

The piston 42 extends partially between the upper stop 32 and the lower stop 34.

The head 48 is able to slide in the cylinder 40.

The head 48 separates the cylinder 40 into two isolated chambers, i.e., an upper chamber 52 and a lower chamber 54.

The lower chamber 54 is partially delimited by the upper stop 32.

The head 48 comprises an upper end 56 facing the first end 44 and a lower end 58 facing the second end 46.

The lower end 58 is able to abut against the upper end 32.

The rod 50 is able to traverse the upper stop 32 along the main axis X at the passage orifice 61 and comprises a free end 60 able to be in contact with the lower stop 34.

The actuator 28 is able to be deployed in a maximum vertical travel position via the supply device 30, in which the lower end 58 comes into contact with the upper end 32 and the free end 60 is in contact with the lower stop 34, more particularly at the bearing 74 of the lower stop.

Advantageously, the upper stop 32 is provided, at the inner surface 62, with a means 65 for damping the contact between the lower end 58 and the upper stop 32, in particular when the piston 42 is in the maximal vertical travel position of the actuator 28.

Alternatively or additionally, the head 48, more particularly the lower end 58, is provided with a means for damping the contact between the lower end 58 and the upper stop 32, in particular when the actuator 28 is in the maximal vertical travel position of the actuator 28.

Advantageously, the outer surface 64 is provided with a damping device 66 configured to damp the contacts between the outer surface 64 and the lower stop 34. The damping device 66 is elastic. The vertical compression rigidity of the damping device 66 is for example from about 70 to 100 daN/mm.

The damping device 66 and the lower stop bearing 74 are vertically aligned, more particularly along the main axis X, and face one another, i.e., they define a space between them extending along X.

The supply device 30 is able to supply the actuator 28 with fluid, for example oil, here at a pressure comprised between 50 bars and 150 bars.

The supply device 30 is configured to control the movement of the piston 42 in the cylinder 40.

The supply device 30 is in particular configured to control the movement of the piston 42 and the maximal vertical travel position of the actuator 28 by creating a pressure difference between the upper chamber 52 and the lower chamber 54 in order to move the piston 42 so that it comes into contact with the lower stop 34 and the upper stop 32.

The supply device 30 for example comprises a reservoir (not shown) positioned at the car 14 and a supply duct 68 configured to supply fluid to the upper chamber 52 and the lower chamber 54.

The conduit 68 connects the reservoir and the upper 52 and lower 54 chambers.

The upper stop 32 and the lower stop 34 are rigid. They are for example made from steel.

The upper stop 32 limits the vertical travel of the actuator 28 when the piston is moved into the maximal vertical travel position. The upper stop 32 limits the movement of the cylinder 40 and the car 14 upward, i.e., opposite the lower stop 34.

The lower stop 34 limits the vertical travel of the actuator 28 when the piston is moved into the maximal vertical travel position. The lower stop 34 limits the movement of the piston 42 downward, i.e., opposite the car 14.

The operation of the secondary suspension system 24, and in particular of the actuator 28, will now be described in detail, using the description of a running method of the railway vehicle 10.

In a first step, the rail vehicle 10 runs on a track 78 and at a distance from the platform 12, for example more than 1 kilometer from the platform 12.

The supply device 30 allows a relative movement between the chassis 22 and the car 14 and the springs 36, 38 are free to fulfill their suspension function.

The supply device 30 then for example does not supply the actuator 28.

The piston 42 is for example substantially completely withdrawn inside the cylinder 40 and the distance between the car 14 and the chassis 22 varies, for example, depending on the movements of the rail vehicle 10, i.e., the set of springs 26, or any contact of the actuator 28 with the lower stop 34.

In this first step, the upper stop 32, more particularly the damping device 66, is able to come into contact with the lower stop bearing 74 following the movements of the car 14 relative to the chassis 22. The damping device 66 then in particular makes it possible to limit the mechanical wear of the secondary suspension system 24.

In other words, during the first step, the piston 42 is not kept abutting against the upper and lower stops. It is for example separated from the upper and lower stops along the axis X.

Alternatively, during the first step, the supply device 30 supplies the actuator 28 to keep the piston 42 in a minimal vertical travel position of the actuator, also called rest position, in which the piston 42 is substantially completely withdrawn inside the cylinder 40.

Then, in a second step, the rail vehicle 10 stops at a station along a platform 12.

The actuator 28 is then supplied by the supply device 30, so as to keep the distance between the chassis 22 and the car 14 constant and prevent the movement of the springs 36, 38. In other words, the actuator 28 is pressurized so as to keep the distance between the upper 32 and lower 34 stops constant and prevent the free movement of the set of springs 26.

The distance between the upper 32 and lower 34 stops is kept substantially equal to the height of the rod 50 and is, for example, comprised between 20 cm and 40 cm, preferably equal to 30 cm.

More specifically, the supply device 30 supplies the actuator 28, so as to move and keep the piston 42 in the maximal vertical travel position.

The piston is then moved downward toward the lower stop, such that the free end 60 comes into contact with the second end 72 of the lower stop, more particularly the lower stop bearing 74. Then, the cylinder 40 moves upward, along the rod 50, until the upper stop 32 bears against the lower end 58 of the head 48 of the piston 42.

The actuator 28 is then in the maximal vertical travel position. The head 48 is kept abutting against the upper stop 32 and the rod 50 is kept abutting against the lower stop 34. The height between the car 14 and the chassis 22 is then fixed and corresponds to the maximal vertical travel of the actuator 28.

The distance between the car 14 and the chassis 22 is for example such that the height from the ground of the floor 20 of the car 14 is substantially equal to the height from the ground of the platform 12, i.e., the floor 20 and the platform 12 extend in a same horizontal plane.

Lastly, the rail vehicle 10 starts from the station and the actuator 28 is then supplied by the supply device 30 or not, so as to allow a relative movement between the chassis 22 and the car 14 and such that the springs 36, 38 are free to fulfill their suspension function.

Alternatively, the supply of the actuator 28 by the supply device 30 begins before the rail vehicle 10 stops, such that when the rail vehicle 10 stops, the floor is already at the height of the platform.

Alternatively, the upper stop 32 and/or the lower stop 34 are respectively part of the car 14 and/or the chassis 22.

Alternatively, the piston 42 of the actuator 28 is secured to the lower stop 34 and comes into contact with the upper stop 32 when the actuator 28 is supplied by the supply device 30.

Alternatively, the mounting of the actuator is reversed and the cylinder 40 is for example secured to the chassis, while the piston 42 moves toward the car 14 when it is supplied by the supply device 30. In this alternative, the cylinder 40 for example forms the lower stop, while the upper stop is positioned at the car 14 facing the rod 50.

Alternatively, the upper stop 32 is formed by a piece secured to the car 14 and is advantageously positioned inside the cylinder 40.

Alternatively, the piston 42 extends between the upper stop 32 and the lower stop 34.

A second embodiment of the invention is shown in FIG. 3 and will be described below. In the second embodiment of the invention, a secondary suspension system 124, different from the secondary suspension system 24 described above, is used.

Subsequently, only the differences between the secondary suspension system 124 and the secondary suspension system 24 will be described, and the similar elements will not be described again and will bear the same references.

The secondary suspension system 124 is globally similar to the secondary suspension system 24 and differs simply in that it comprises a different supply device 130 and a return spring 133 positioned inside the lower chamber 54.

The supply device 130 is configured to supply only one of the upper and lower chambers, namely the upper chamber 52 in the example shown in FIG. 3.

The supply device 130 comprises a supply conduit 68 configured to supply only the upper chamber 52.

The return spring 133 is configured to return the piston 42 to the minimal vertical travel position, inside the cylinder 40, when the actuator is not supplied by the supply device 30.

The return spring 133 is positioned in the lower chamber between the second end 46 and the lower end 58.

Alternatively, when the supply device is configured to supply the lower chamber, the return spring is positioned in the upper chamber between the first end 44 and the upper end 56.

The return spring 133 for example makes it possible to keep the actuator 28 in the minimal vertical travel position in which the piston 42 is substantially completely withdrawn inside the cylinder 40.

In both embodiments of the invention, the upper stop 32, the lower stop 34 and the actuator 28, when it is supplied so as to be in its maximal travel configuration, make it possible to ensure that the car is easily accessible from the platform. This in particular favors movements by persons with reduced mobility or the loading of bulky and/or heavy goods.

The upper stop 32, the lower stop 34 and the actuator 28, when it is supplied so as to be in its maximal travel configuration, then form a non-deformable assembly with a constant height. Indeed, the piston 42 is then in contact with the upper stop 32 and the lower stop 34 and forms a rigid assembly with the upper and lower stops.

The secondary suspension systems 24, 124 provide a leveling system that is easy to implement and does not require feedback for the height of the floor of the car.

The embodiments described above may be combined to create new embodiments.

The invention claimed is:

1. A rail vehicle, comprising a car and at least one bogie that carries the car, the bogie comprising:

a chassis; and a secondary suspension system between the chassis and the car, the secondary suspension system comprising a spring assembly mounted between the chassis and the car, wherein the secondary suspension system comprises an actuator that includes a piston extending at least partially between an upper stop secured to the car and a lower stop secured to the chassis, and a supply device of the actuator, the supply device of the actuator being configured to supply the actuator such that a distance between the upper stop and the lower stop is kept constant by the actuator, wherein the actuator also includes a cylinder, the piston separating the cylinder into an upper chamber and a lower chamber, and wherein the supply device of the actuator is configured to supply only one of the upper and lower chambers, the other of the upper and lower chambers being equipped with a return spring configured to return the piston to a rest position inside the cylinder when the actuator is not supplied by the supply device.

2. The rail vehicle according to claim 1, wherein the upper stop and the lower stop are vertically aligned.

3. The rail vehicle according to claim 1, wherein the supply device of the actuator is configured to supply the actuator such that the piston is positioned completely inside the cylinder.

4. The rail vehicle according to claim 1, wherein the supply device of the actuator is configured to supply the actuator such that the piston comes into contact with the lower stop and the upper stop, the actuator then being in a maximum vertical travel position and the distance between the upper stop and the lower stop being kept constant.

5. The rail vehicle according to claim 4, wherein the piston comprises a head and a rod extending from the head and traversing the cylinder, and wherein the supply device of the actuator is configured to supply the actuator such that the head of the piston is kept abutting against the upper stop and the rod of the piston is kept abutting against the lower stop.

6. The rail vehicle according to claim 5, wherein the cylinder comprises an end, the upper stop being fastened to said end, the upper stop being provided with a passage orifice for the rod.

7. The rail vehicle according to claim 1, wherein the actuator is situated inside the spring assembly along a main axis of the secondary suspension.

8. A running method of a rail vehicle according to claim 1, comprising the following steps:

running of the rail vehicle, the actuator being supplied by the supply device, so as to allow a relative movement between the chassis and the car; and stop of the rail vehicle at a platform, the actuator being supplied by the supply device, so as to keep the distance between the chassis and the car constant.

* * * * *